US005193351A

United States Patent [19]

Laukhuf et al.

[11] Patent Number: 5,193,351

[45] Date of Patent: Mar. 16, 1993

[54] REFRIGERANT RECOVERY AND PURIFICATION SYSTEM

[75] Inventors: Gregg E. Laukhuf, Bryan; Walter D. Murray, Pioneer; Todd J. Arend, Defiance; Gary P. Murray, Montpelier, all of Ohio

[73] Assignee: SPX Corporation, Muskegon, Mich.

[21] Appl. No.: 843,250

[22] Filed: Feb. 28, 1992

[51] Int. Cl.[5] ..... F25B 19/00

[52] U.S. Cl. ..... 62/77; 62/231; 62/292; 62/85; 62/475; 62/505; 62/195

[58] Field of Search ..... 62/77, 85, 149, 195, 62/292, 475, 505, 231; 236/46 F

[56] References Cited

U.S. PATENT DOCUMENTS

| | | | |
|---|---|---|---|
| 4,261,178 | 4/1981 | Cain | 62/292 |
| 4,290,274 | 9/1981 | Essex | 236/46 F |
| 4,768,347 | 9/1988 | Manz et al. | 62/292 |
| 4,809,520 | 3/1989 | Manz et al. | 62/292 |
| 4,998,416 | 3/1991 | Van Steenburgh, Jr. | 62/292 |
| 5,038,578 | 8/1991 | Manz et al. | 62/292 |
| 5,086,630 | 2/1992 | Van Steenburgh, Jr. | 62/292 |
| 5,115,645 | 5/1992 | Abraham | 62/292 |

FOREIGN PATENT DOCUMENTS 209511 5/1984 Fed. Rep. of Germany .

*Primary Examiner*—John Sollecito

*Attorney, Agent, or Firm*—Barnes, Kisselle, Raisch, Choate, Whittemore & Hulbert

[57] ABSTRACT

A refrigerant recovery and purification system that includes a refrigerant compressor having an inlet for connection to refrigeration equipment under service from which refrigerant is to be recovered. The outlet of the compressor is connected through a condenser to a refrigerant storage vessel or container, with the condenser at least partially liquifying refrigerant prior to passage to the storage container. A liquid refrigerant pump is connected for selectively circulating refrigerant in liquid phase in a closed path from the storage container through a filter for removing contaminants from the refrigerant, and then through the condenser back to the storage container. Refrigerant circulated by the liquid pump in the closed path is thus simultaneously purified by passage through the filter and cooled by passage through the condenser. Thus, in the event of impending overheating of the compressor during a recovery cycle and/or pressure build-up with the container during a recovery operation, the operator may suspend the recovery cycle and initiate a purification cycle in which refrigerant within the container will be sub-cooled by passage through the condenser, while the compressor has an opportunity to cool when not used.

22 Claims, 2 Drawing Sheets

REFRIGERANT RECOVERY AND PURIFICATION SYSTEM

The present invention is directed to refrigerant recovery and purification systems, and more particularly to a system and method of the described character constructed for enhanced operation at elevated ambient temperature.

BACKGROUND AND OBJECTS OF THE INVENTION

Many scientists content that release of halogen refrigerants into the atmosphere deleteriously affects the ozone layer that surrounds and protects the earth from ultraviolet solar radiation. Recent international discussions and treaties, coupled with related regulations and legislation, have renewed interest in devices for recovery and storage of used refrigerants from refrigeration equipment for later purification and reuse or for proper disposal. U.S. Pat. No. 4,261,178, assigned to the assignee hereof, discloses a refrigerant recovery system in which the inlet of a compressor is coupled through an evaporator and through a manual valve to the refrigeration equipment from which refrigerant is to be recovered. The compressor outlet is connected through a condenser to a refrigerant storage container. The condenser and evaporator are combined in a single assembly through which cooling air is circulated by a fan. Content of the storage container is monitored by a scale on which the container is mounted for sensing weight of liquid refrigerant in the container, and by a pressure switch coupled to the fluid conduit between the condenser and the container for sensing vapor pressure within the storage container. A full-container condition sensed at the scale or a high-pressure condition sensed at the pressure switch terminates operation of the compressor motor. A vacuum switch is positioned between the inlet valve and the evaporator for sensing evacuation of refrigerant from the refrigeration system and automatically terminating operation of the compressor motor.

U.S. Pat. Nos. 4,768,347, 4,809,520 and 5,038,375, also assigned to the assignee hereof, disclose a refrigerant recovery system that includes a compressor having an inlet coupled through an evaporator and through a solenoid valve to the refrigeration equipment from which refrigerant is to be recovered, and an outlet coupled through a condenser to a refrigerant storage container or tank. The refrigerant storage container is carried by a scale having a limit switch coupled to control electronics to prevent or terminate further refrigerant recovery when the container is full. The scale comprises a platform pivotally mounted by a hinge pin to a wheel cart, which also carries the evaporator/condenser unit, compressor, control electronics, and associated valves and hoses.

Although the systems disclosed in the noted patents address and overcome problems theretofore extant in the art, further improvements remain desirable. For example, a problem remains relative to operation at elevated ambient temperature conditions. Problems have been encountered in connection with thermal overload at the compressor or termination of operation due to high pressure within the refrigerant storage container. Condensing capacity of the condenser could be increased, which would reduce compressor load but increase cost of the unit. Alternatively, compressor suction pressure could be decreased to decrease mass flow rate and condenser heat rejection requirements. However, efficient operation of the unit favors increased rather than decreased refrigerant mass flow rate.

It is therefore an object of the present invention to provide a refrigerant recovery system, and more specifically a refrigerant recovery and purification system of the described character, having enhanced capabilities for efficient and reliable operation at both normal and elevated ambient temperatures. A more specific object of the present invention is to provide a system of the described character that is economical to manufacture and reliable over an extended operating lifetime. A further object of the present invention is to provide a system of the described character that satisfies the foregoing objectives while being easy to operate.

SUMMARY OF THE INVENTION

A refrigerant recovery and purification system in accordance with the present invention includes a refrigerant compressor having an inlet for connection to refrigeration equipment under service from which refrigerant is to be recovered. The outlet of the compressor is connected through a condenser to a refrigerant storage vessel or container, with the condenser at least partially liquifying refrigerant prior to passage to the storage container. In accordance with a first aspect of the invention, a liquid refrigerant pump is connected for selectively circulating refrigerant in liquid phase in a closed path from the storage container both through a filter for removing contaminants from the refrigerant, and thence through the condenser back to the storage container. Refrigerant circulated by the liquid pump in the closed path is thus simultaneously purified by passage through the filter and cooled by passage through the condenser. Thus, in the event of impending overheating of the compressor during a recovery cycle and/or pressure build-up with the container during a recovery operation, the operator may suspend the recovery cycle and initiate a purification cycle in which refrigerant within the container will be sub-cooled by passage through the condenser, while the compressor has an opportunity to cool when not used.

In accordance with a second aspect of the present invention, which may be employed separately from or more preferably in combination with other aspects of the invention, the compressor inlet is connected to the equipment under service by an evaporator disposed in heat exchange relationship with the condenser. The evaporator includes at least one evaporator coil, and the condenser comprises at least first and second condenser coils disposed on opposite sides of the evaporator coil, and a condenser fan for blowing air over the first condenser coil, the evaporator coil and the second condenser coil in sequence. This condenser/evaporator/condenser coil construction has the advantage of increasing the condenser capacity of the combination coil and fan. The ambient air is heated when blowing across the first condenser coil and then cooled when blowing across the evaporator coil. The additional cooling provided by the evaporator coil enhances heat transfer in the second condenser coil. The additional cooling provided by the evaporator coil enhances heat transfer in the second condenser coil. This results in a lower condensing pressure or increased refrigerant flow depending on the provided controls.

In accordance with yet another aspect of the present invention, which again may be employed either separately from or more preferably in combination with other aspects of the invention, a solenoid valve is connected between the refrigerant condenser and the storage container, and is operatively coupled to the compressor for selectively applying refrigerant over electrical coils within the compressor to cool the compressor. An electrical timer is connected to the solenoid of the valve for automatically supplying control signals to the valve solenoid at preselected periodic intervals during operation of the compressor, such as for one or two seconds every minute, for cooling the compressor during operation without operator intervention.

BRIEF DESCRIPTION OF THE DRAWINGS

The invention, together with additional objects, features and advantages thereof, will be best understood from the following description, the appended claims and the accompanying drawings, FIGS. 1A and 1B, which together comprise a schematic diagram, interconnected by the terminals A and B in each figure, of a presently preferred embodiment of the invention.

DETAILED DESCRIPTION OF PREFERRED EMBODIMENT

Figure 1A:
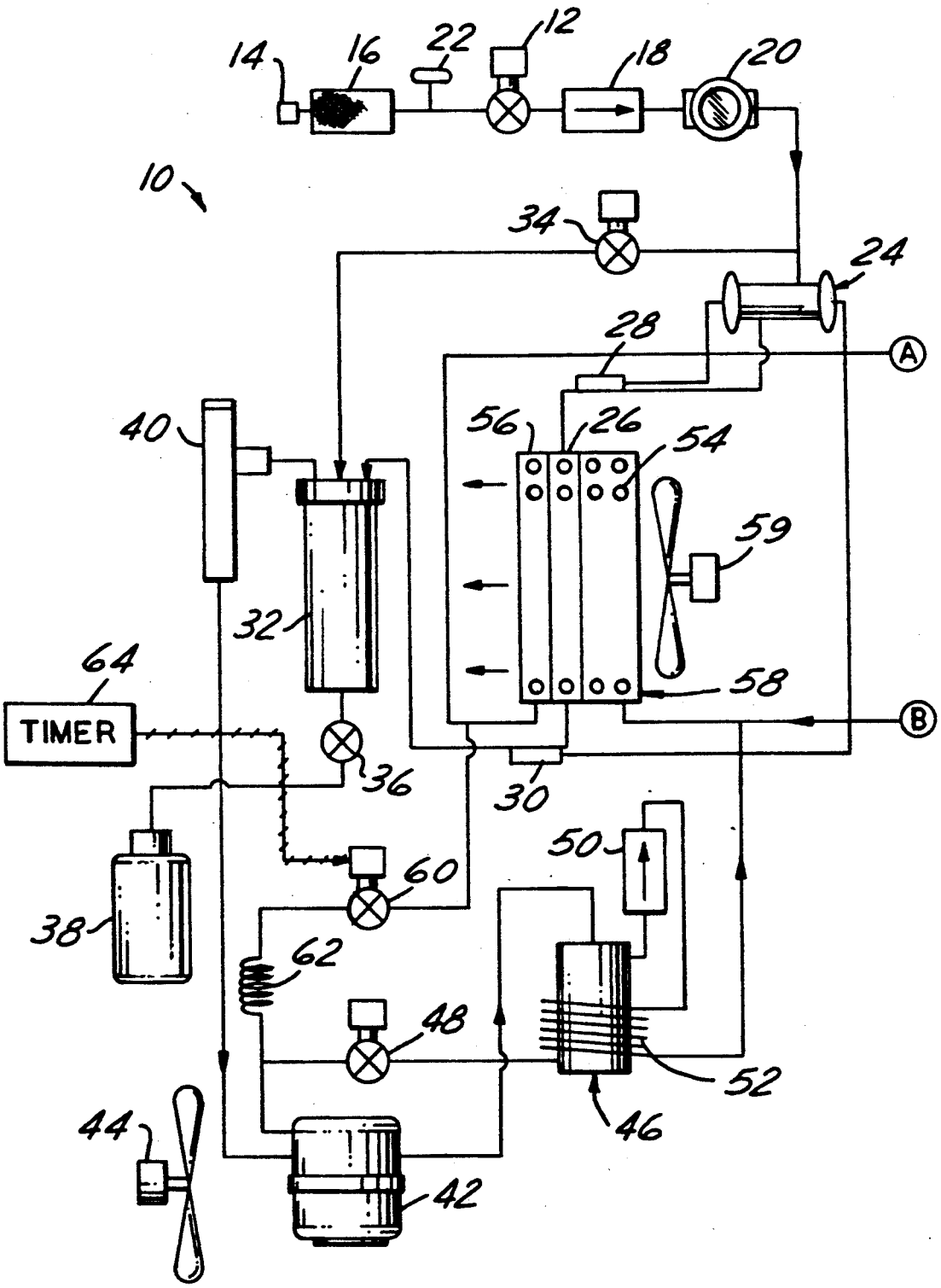
Figure 1B:
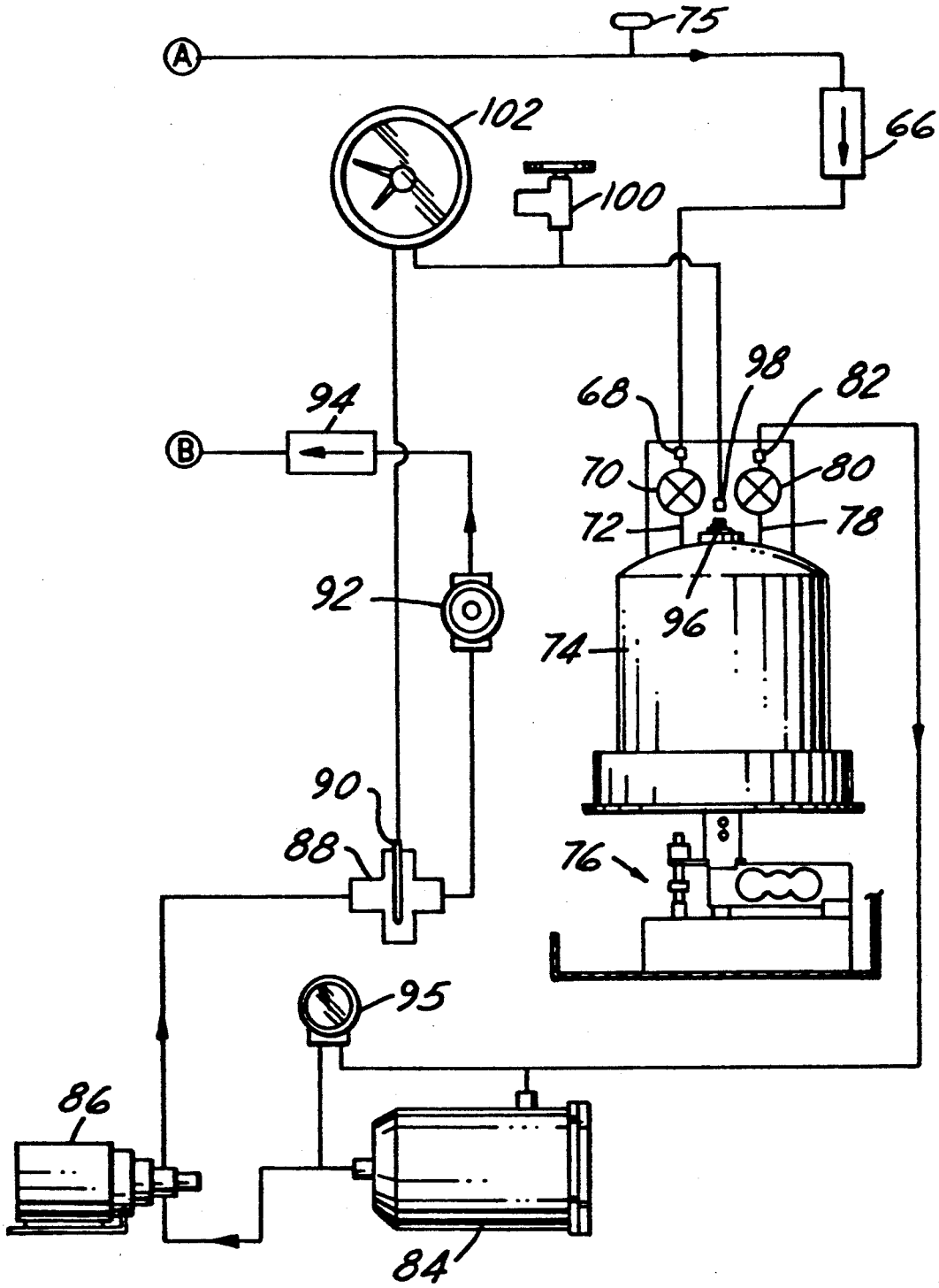

FIGS. 1A and 1B illustrate a refrigerant recovery system 10 in accordance with a presently preferred embodiment of the invention as comprising an input solenoid valve 12 coupled to a connector 14 for connection to equipment from which refrigerant is to be withdrawn or recovered. Refrigerant from connector 14 is fed through a filter 16 and a check valve 18 to a sight glass 20 for operator observation of inlet refrigerant phase. A pressure sensor 22 is connected between filter 16 and valve 12. Sight glass 20 is connected through a flow control valve 24 to the inlet side of an evaporator coil 26. Control inputs to valve 24 are connected to refrigerant bulbs 28,30 positioned at the inlet and outlet sides of evaporator coil 26 respectively. Structure and function of control valve 24 and bulbs 28,30 are disclosed in detail in co-pending application Ser. No. 07/641,433 assigned to the assignee hereof, to which reference may be made for more detailed discussion.

The outlet of evaporator coil 26 is connected to the inlet of an oil separator 32. Oil separator 32 also receives a refrigerant input from sight glass 20 through a solenoid valve 34. Thus, when liquid or mixed liquid/vapor phase refrigerant is detected by an operator at sight glass 20, valve 34 is closed, and the liquid refrigerant is fed through evaporator coil 26 to oil separator 32. On the other hand, when the operator observes at sight glass that input refrigerant is in vapor phase, solenoid valve 34 is opened by the operator so that inlet refrigerant is fed directly to separator 32. In either case, separator 32 receives refrigerant in vapor phase, from which any oil droplets collect at the lower portion of the separator and are selectively drained through a manual valve 36 to a catch bottle 38.

Refrigerant in vapor phase is fed from oil separator 32 through a pressure regulator 40 to the inlet of a refrigerant compressor 42. Compressor 42 is cooled by a fan 44. Pressure regulator 40 limits suction pressure to the compressor, and thereby helps reduce overheating at the compressor. For example, regulator 40 may be set at 70 psig for operation of system 10 in connection with R12, R22 and R502 refrigerant. If suction pressure at compressor 42 is below the 70 psig setting, valve 40 will be fully open and allow unrestricted flow of refrigerant vapor to the compressor. In the event that suction pressure is above 70 psig, valve 40 will modulate refrigerant vapor flow to maintain 70 psig suction pressure at the compressor. For example, on a cool day, evaporator temperature might be 38° F. For R12 refrigerant, the pressure and density at the evaporator outlet would be 35 psig and 1.27 lbs./cu. ft. respectively, and valve 40 would be fully open. On a very hot day, the evaporator temperature might be 50° F. For R12 refrigerant, the pressure and density would be 47 psig and 1.53 lbs./cu. ft. respectively, and valve 40 would be fully open. On the other hand, for R22 refrigerant, the pressure and density would be 84 psig and 1.80 lbs./cu. ft., and valve 40 would modulate refrigerant flow so as to limit compressor suction pressure. In the same way, for R502 refrigerant at an evaporator temperature of 50° F., pressure and density would be 97 psig and 2.64 lbs./cu. ft. respectively, and valve 40 would operate to limit compressor suction pressure to 70 psig.

The outlet of compressor 42 is connected to a compressor oil separator 46, from which return oil is fed through a solenoid valve 48 to the compressor inlet. The refrigerant outlet of separator 46 is connected through a check valve 50 to a coil 52 that surrounds oil separator 46 in heat exchange relation with the separator wall and refrigerant within the separator. The general structure and function of separator 46 with coil 52 are disclosed in U.S. Pat. No. 5,042,271, to which reference may be made for further details. The outlet end of coil 52 is connected through a two-coil condenser section 54, and thence through a single-coil condenser section 56. Condenser coil sections 54,56 are disclosed on opposite sides of evaporator coil section 26, to form a combined condenser/evaporator/condenser coil assembly 58. A fan 59 is positioned adjacent to assembly 58 for blowing ambient air through condenser coil section 54, evaporator coil 26 and condenser coil section 56 in sequence. The outlet side of condenser coil section 56 is connected through a solenoid valve 60 and a capillary tube 62 to an inlet of compressor 42. The solenoid of valve 60 is controlled by an electrical timer 64. During operation of compressor 42, timer 64 supplies control signals to valve 60 at preselected periodic intervals, such as for one to two seconds every minute, so as to apply refrigerant under pressure onto the electrical coils of compressor 52 and thereby cool operation of the compressor.

The outlet side of condenser section 56 is also connected through a check valve 66 (FIG. 1B) and a coupler 68 to the valve 70 at the vapor port 72 of a refrigerant storage container 74. A sensor 75 indicates excessive condenser outlet pressure. Container 74 is mounted on a strain gauge scale 76 for providing a signal to recovery/purification control circuitry (not shown) indicative of weight of refrigerant within the container. The liquid port 78 of container 74 is connected through a valve 80 and a coupler 82 to a filter 84 for removing water and other contaminants from refrigerant passing therethrough. A liquid refrigerant pump 86 receives refrigerant from filter 84, and pumps refrigerant through a chamber 88 in heat exchange relationship with refrigerant captured within a bulb 90. The outlet side of chamber 88 is connected through a sight glass 92 and a check valve 94 to the inlet side of condenser section 54 (FIG. 1A) of condenser/evaporator/condenser assembly 58 in parallel with the outlet from oil separator coil 52. A differential pressure gauge 95 is connected across filter 84 for indicating operative condition of the filter.

The purge port 96 of container 74 (FIG. 1B) is coupled by a coupler 98 to a manual valve 100, and to one input of a double-needle gauge 102. The second input of gauge 102 is connected to bulb 90. Gauge 102 thus reads a pressure differential between air captured within storage container 74 and the refrigerant within bulb 90, and the system operator may selectively purge air from within container 74 by operation of valve 100. The structure and function of such air purge system are disclosed in greater detail in U.S. Pat. No. 5,005,369 and U.S. application Ser. No. 07/576,952 assigned to the assignee hereof, to which reference may be made for further details.

In operation, connector 14 (FIG. 1A) is coupled to refrigeration equipment from which refrigerant is to be recovered, and connectors 68,82 and 98 are connected to storage container 74 (FIG. 1B) as shown. Compressor 42 is energized and valve 112 is opened to initiate a refrigerant recovery operation. Fan 44 is energized whenever compressor 52 is energized, and fan 59 is engaged whenever compressor 42 or pump 86 is energized. If incoming refrigerant is in liquid or mixed liquid/vapor phase as observed by the operator at sight glass 20, solenoid valve 34 remains closed and incoming refrigerant is fed to oil separator 32 through valve 24 and evaporator section 26 of combined condenser-/evaporator/condenser assembly 58. On the other hand, if the operator observes at sight glass 20 that incoming refrigerant is in vapor phase, the operator energizes and opens solenoid valve 34 so that incoming refrigerant is fed directly to evaporator 32, eliminating superheating of incoming refrigerant vapor within the evaporator. In either case, incoming refrigerant is withdrawn from separator 32 by compressor 42 through valve 40 at regulated pressure as described above.

Refrigerant is pumped from the outlet of compressor 42 through compressor oil separator 46, and thence through condenser coil sections 54,56 of combined assembly 58 to container 74 through valve 68 (FIG. 1B). The advantage of dividing the condenser portions of combined condenser/evaporator/condenser assembly 58 into two condenser coil sections 54,56, and positioning the condenser coil sections on opposite sides of the evaporator coil section, is discussed above.

When pressure sensor 22 (FIG. 1A) senses that all refrigerant has been withdrawn from the equipment under service, power is removed from compressor 42 and the refrigerant recovery cycle is completed. To initiate a refrigerant purification cycle, power is applied to liquid refrigerant pump 86. Liquid refrigerant is withdrawn from container 74 and pumped through filter 84, vessel 88, sight glass 92 and check valve 94 to condenser section 54. Fan 59 is operated during the purification cycle, so that the liquid refrigerant is cooled during passage through condenser sections 54,56 prior to return to vapor port 72 of container 74 through check valve 66. This routing of refrigerant through the condenser during the purification cycle has the important advantage of sub-cooling the liquid refrigerant returned to container 74, and thereby cooling the contents of the storage container. If, during a recovery cycle, pressure within vessel 74 increases due to high ambient temperature conditions or due to excess air within the storage container, the operator may suspend the recovery cycle and initiate a purification cycle for both cooling the contents of container 74 and purging air within the container through operation of gauge 102 and valve 100. In this connection, air purge temperature sensing vessel 88 may be connected at any portion of the closed refrigerant path between port 78 and port 72 through pump 86.

We claim:

1. A refrigerant recovery and purification system that comprises:

a refrigerant compressor having an inlet and an outlet, means for connecting said compressor inlet to refrigeration equipment from which refrigerant is to be recovered, means including refrigerant condenser means for connecting said compressor outlet to a refrigerant storage container, filter means for removing contaminants from refrigerant passing therethrough, and means including a liquid refrigerant pump for selectively circulating refrigerant in liquid phase in a closed path from the storage container through both said filter means and said condenser means back to the storage container simultaneously to purify the refrigerant by passage through said filter means and cool the refrigerant by passage through said condenser means.

2. The system set forth in claim 1 further comprising means disposed in said closed path for operative coupling to the storage container for selectively venting air captured within the container.

3. The system set forth in claim 1 further comprising means disposed in said closed path for indicating moisture content of refrigerant passing therethrough.

4. The system set forth in claim 3 further comprising means coupled to said filter means for indicating operative condition of said filter means.

5. The system set forth in claim 4 wherein said condition-indicating means comprises a differential pressure gauge connected across said filter means.

6. The system set forth in claim 5 further comprising means disposed in said closed path for operative coupling to the storage container for selectively venting air captured within the container.

7. The system set forth in claim 1 wherein said means for connecting said compressor inlet to the refrigeration equipment includes evaporator means in heat exchange relationship with said condenser means.

8. The system set forth in claim 7 wherein said evaporator means comprises at least one evaporator coil, and wherein said condenser means comprises at least first and second condenser coils and a fan for blowing air over said first condenser coil, said evaporator coil and said second condenser coil in sequence.

9. The system set forth in claim 1 further comprising means connected in said closed path between said condenser means and the storage container and operatively coupled to said compressor for selectively applying refrigerant over electrical coils of said compressor to cool said compressor.

10. The system set forth in claim 9 wherein said applying means comprises an electrical valve connected between said closed path and said compressor, and timing means coupled to said valve for periodically supplying an electrical signal to said valve to open said valve.

11. The system set forth in claim 10 wherein said timing means automatically supplies said signal at preselected periodic intervals.

12. A refrigerant recovery system that comprises:

a refrigerant compressor having an inlet and an outlet, means including evaporator means for connecting said compressor inlet to refrigeration equipment from which refrigerant is to be recovered, means including refrigerant condenser means for connecting said compressor outlet to a refrigerant storage container, said evaporator means comprising at least one evaporator coil, and said condenser means comprising at least first and second condenser coils and a fan for blowing air over said first condenser coil, said evaporator coil and said second condenser coil in sequence, filter means for removing contaminants from refrigerant passing therethrough, and means including a liquid refrigerant pump for selectively circulating refrigerant in liquid phase in a closed path from the storage container through both said filter means and said condenser means back to the storage container simultaneously to purify the refrigerant by passage through said filter means and cool the refrigerant by passage through said condenser means.

13. The system set forth in claim 12 further comprising means connected in said closed path between said condenser means and the storage container and operatively coupled to said compressor for selectively applying refrigerant over electrical coils of said compressor to cool said compressor.

14. The system set forth in claim 13 wherein said applying means comprises an electrical valve connected between said closed path and said compressor, and timing means coupled to said valve for periodically supplying an electrical signal to said valve to open said valve.

15. The system set forth in claim 14 wherein said timing means automatically supplies said signal at preselected periodic intervals.

16. A refrigerant recovery system that comprises:

a refrigerant compressor having an inlet and an outlet, means for connecting said compressor inlet to refrigeration equipment from which refrigerant is to be recovered, means including refrigerant condenser means for connecting said compressor outlet to a refrigerant storage container, an electrical solenoid valve connected between said condenser means and the storage container and operatively coupled to said compressor for selectively applying refrigerant over electrical coils in said compressor to cool said compressor, timing means coupled to said valve for periodically supplying an electrical signal to said valve to open said valve, filter means for removing contaminants from refrigerant passing therethrough, and means including a liquid refrigerant pump for selectively circulating refrigerant in liquid phase in a closed path from the storage container through both said filter means and said condenser means back to the storage container simultaneously to purify the refrigerant by passage through said filter means and cool the refrigerant by passage through said condenser means.

17. The system set forth in claim 16 wherein said timing means automatically supplies said signal at preselected periodic intervals.

18. The system set forth in claim 16 wherein said means for connecting said compressor inlet to the refrigeration equipment includes evaporator means in heat exchange relationship with said condenser means.

19. The system set forth in claim 18 wherein said evaporator means comprises at least one evaporator coil, and wherein said condenser means comprises at least first and second condenser coils and a fan for blowing air over said first condenser coil, said evaporator coil and said second condenser coil in sequence.

20. In a refrigerant recovery and purification system that includes a compressor and condenser for recovering refrigerant from refrigeration equipment under service and feeding such refrigerant to a storage vessel, and a liquid refrigerant pump for directing refrigerant in liquid phase from the vessel through a filter and back to the vessel in a closed path, a method of cooling refrigerant in the vessel comprising the step of directing the refrigerant in said closed path through said condenser.

21. The method set forth in claim 20 comprising the additional step of blowing cooling air over said condenser as liquid phase refrigerant is pumped therethrough.

22. The system set forth in claim 21 comprising the additional step of cooling said compressor during operation thereof by directing refrigerant into electrical coils of said compressor at preselected periodic intervals.

* * * * *